US008474379B2

(12) United States Patent
Jacobson et al.

(10) Patent No.: US 8,474,379 B2
(45) Date of Patent: Jul. 2, 2013

(54) REMOTE FIRING DEVICE WITH DIVERSE INITIATORS

(75) Inventors: Thomas Lee Jacobson, Sedro-Woolley, WA (US); Neal H Rothenbuhler, Acme, WA (US); Richard B Taft, Sedro-Woolley, WA (US)

(73) Assignee: Rothenbuhler Engineering Co., Sedro-Woolley, WA (US)

( * ) Notice: Subject to any disclaimer, the term of this patent is extended or adjusted under 35 U.S.C. 154(b) by 778 days.

(21) Appl. No.: 12/353,203

(22) Filed: Jan. 13, 2009

(65) Prior Publication Data

US 2010/0005994 A1 Jan. 14, 2010

Related U.S. Application Data

(63) Continuation-in-part of application No. 11/038,780, filed on Jan. 18, 2005, now abandoned.

(60) Provisional application No. 60/537,153, filed on Jan. 16, 2004.

(51) Int. Cl.
*F23Q 21/00* (2006.01)
*F42D 1/05* (2006.01)

(52) U.S. Cl.
USPC ..... 102/215; 102/200; 102/301; 102/311; 102/217

(58) Field of Classification Search
USPC ..... 102/215, 310, 311, 312, 313, 320–321.1, 102/200, 217, 275.6, 301
See application file for complete search history.

(56) References Cited

U.S. PATENT DOCUMENTS

| | | | | |
|---|---|---|---|---|
| 3,401,631 | A | 9/1968 | Hannagan | |
| 3,440,962 | A | 4/1969 | Madlener | |
| 4,674,047 | A * | 6/1987 | Tyler et al. | 89/28.05 |
| 4,860,653 | A * | 8/1989 | Abouav | 102/200 |
| 5,014,622 | A | 5/1991 | Jullian | |
| 5,206,455 | A * | 4/1993 | Williams et al. | 102/201 |
| 6,173,651 | B1 | 1/2001 | Pathe | |
| 6,247,408 | B1 | 6/2001 | Andrejkovies | |
| 6,490,977 | B1 * | 12/2002 | Bossarte et al. | 102/342 |
| 6,546,873 | B1 * | 4/2003 | Andrejkovics et al. | 102/200 |

(Continued)

FOREIGN PATENT DOCUMENTS

| | | |
|---|---|---|
| EP | 0 301 848 A2 | 2/1989 |
| WO | 00/24999 A1 | 5/2000 |

(Continued)

OTHER PUBLICATIONS

"Boeing LGM-30A 'Minuteman I' ICBM," Hill Aerospace Museum <http://web.archive.org/web/20051217122015 /http://www.hill.af.mil/museum/photos/coldwar/lgm-30a.htm> [retrieved Dec. 13, 2006].

(Continued)

*Primary Examiner* — James Bergin
(74) *Attorney, Agent, or Firm* — Christensen O'Connor Johnson Kindness PLLC

(57) ABSTRACT

A remote firing system for remotely detonating explosive charges includes features that provide safety and efficiency improvements. These features include safety communication among multiple remote devices and multiple controller devices, a polling functionality permitting rapid deployment of system devices, electronic key systems, programmable remote devices for easy replacement of failing remote devices, and an event history log for the remote devices for efficient diagnostic evaluation.

6 Claims, 9 Drawing Sheets

U.S. PATENT DOCUMENTS

| | | | | |
|---|---|---|---|---|
| 6,732,656 | B1 | 5/2004 | Heyse | |
| 6,799,517 | B1 * | 10/2004 | Cahill | 102/401 |
| 6,857,369 | B2 | 2/2005 | Bossarto et al. | |
| 7,021,216 | B1 * | 4/2006 | Dragne et al. | 102/200 |
| 7,347,278 | B2 * | 3/2008 | Lerche et al. | 175/4.55 |
| 7,370,583 | B2 * | 5/2008 | Bokvist et al. | 102/200 |
| 2001/0045883 | A1 * | 11/2001 | Holdaway et al. | 340/5.51 |
| 2003/0159609 | A1 | 8/2003 | Rauscher, Jr. | |
| 2005/0000382 | A1 | 1/2005 | Hummel | |
| 2005/0011388 | A1 | 1/2005 | Kouznetsov | |
| 2005/0217525 | A1 | 10/2005 | McClure | |
| 2006/0011082 | A1 | 1/2006 | Jacobson | |
| 2007/0119326 | A1 * | 5/2007 | Rudakevych et al. | 102/206 |
| 2010/0083859 | A1 * | 4/2010 | Bossarte et al. | 102/342 |

FOREIGN PATENT DOCUMENTS

| | | | |
|---|---|---|---|
| WO | 01/59401 | A1 | 8/2001 |
| WO | 01/67031 | A1 | 9/2001 |
| WO | 2005/052498 | A1 | 6/2005 |
| WO | 2005/071348 | A1 | 8/2005 |

OTHER PUBLICATIONS

"Search Results for Jan 1, 1996-Sep 6, 2007," Internet Archive Wayback Machine, <http://web.archive.org/web/*/http://www.hill.af.mil/museum/photos/coldwar/lgm-30a.htm> [retrieved Sep. 6, 2007].

"Titan Control Room: Missile Launch Status Panel," www.flickr.com [retrieved Dec. 13, 2006].

King, J.C., "The Venerable Titan II ICBM (LGM-25C)," <http://userhp.konnect/net/jcking/missile_story.html> [retrieved Dec. 13, 2006].

Restriction Requirement dated Oct. 24, 2006, from U.S. Appl. No. 11/038,780, filed Jan. 18, 2005, now abandoned, of which the present application is a Continuation-in-Part.

Response to Restriction Requirement dated Nov. 21, 2006, from U.S. Appl. No. 11/038,780, filed Jan. 18, 2005, now abandoned, of which the present application is a Continuation-in-Part.

Office Action dated Feb. 14, 2007, from U.S. Appl. No. 11/038,780, filed Jan. 18, 2005, now abandoned, of which the present application is a Continuation-in-Part.

Amendment A dated Jul. 13, 2007, from U.S. Appl. No. 11/038,780, filed Jan. 18, 2005, now abandoned, of which the present application is a Continuation-in-Part.

Notice of Non-Responsive Amendment dated Aug. 6, 2007, from U.S. Appl. No. 11/038,780, filed Jan. 18, 2005, now abandoned, of which the present application is a Continuation-in-Part.

Response to Notice of Non-Responsive Amendment dated Sep. 6, 2007, from U.S. Appl. No. 11/038,780, filed Jan. 18, 2005, now abandoned, of which the present application is a Continuation-in-Part.

Final Office Action dated Dec. 13, 2007, from U.S. Appl. No. 11/038,780, filed Jan. 18, 2005, now abandoned, of which the present application is a Continuation-in-Part.

International Search Report mailed Sep. 30, 2010, issued in corresponding PCT/US2009/068742, filed Dec. 18, 2009, 1 page.

New Zealand Examination Report mailed Sep. 19, 2012, issued in corresponding New Zealand Application No. 593835, filed Dec. 18, 2009, 3 pages.

Australia Patent Examination Report No. 1, mailed Apr. 22, 2013, issued in corresponding Australian Application No. 2009341587, filed Dec. 18, 2009, 4 pages.

* cited by examiner

REMOTE FIRING DEVICE WITH DIVERSE INITIATORS

CROSS-REFERENCES TO RELATED APPLICATIONS

This application is a continuation-in-part of U.S. application Ser. No. 11/038,780, filed Jan. 18, 2005, which claims the benefit of U.S. Provisional Application No. 60/537,153, filed Jan. 16, 2004, the disclosures of which are hereby expressly incorporated by reference in their entirety.

BACKGROUND

Blasting technologies have expedited mining operations, such as surface mining and subterranean mining, by allowing the strategic and methodic placement of charges within the blasting site. Despite this, blasting technologies still carry safety risks that should be minimized. Effective blasting requires not only well-placed detonators, but also timed detonation of the charges, preferably in a predetermined sequence. Accordingly, accurate and precise control and firing of the detonators is important for effective and efficient blasting. The more precise and accurate control of the detonators also leads to an increase in safety of the system overall. Thus, it is desirable to have a blasting system that effectively and efficiently controls the detonation of various types of charges while simultaneously increasing the overall safety of the system.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with the disclosed subject matter, a remote firing system, a controller device, a remote device, and a method for remotely detonating explosives is provided. The system form of the disclosed subject matter includes a remote firing system that comprises a set of remote devices. Each remote device is capable of communicating a safety data structure that contains a system identifier for identifying the remote firing system from other remote firing systems and a device identifier for identifying a remote device from other remote devices. The remote firing system further includes a controller device for causing the set of remote devices to trigger detonators. The controller device is capable of selecting a subset of the set of remote devices for triggering detonators and further being capable of communicating the safety data structure that contains a system identifier for identifying the remote firing system from other remote firing systems and device identifiers for identifying the subset of remote devices to control.

In accordance with further aspects of the disclosed subject matter, a device form of the disclosed subject matter includes a controller device that includes a set of selection and information panels that correspond with a set of remote devices. A subset of selection and information panels is selectable to cause a corresponding subset of remote devices to be selected for detonating explosives. The controller device further includes a communication module for transmitting and receiving safety communication. The communication module is capable of communicating with the subset of remote devices to indicate their selection for detonating explosives by the controller device.

In accordance with further aspects of the disclosed subject matter, a remote device that includes a communication module for transmitting and receiving a safety data structure that contains a system identifier for identifying a remote firing system that comprises the remote device and a device identifier for identifying the remote device. The remote device also includes a memory for recording state changes of the remote device. The remote device further includes a switch for selecting either shock-tube detonator initiation or electric detonator initiation.

In accordance with further aspects of the disclosed subject matter, a method for remotely detonating explosives. The method includes selecting a subset of a set of selection and information panels on a controller device to cause a corresponding subset of remote devices to be selected for detonating explosives. The method further includes issuing an arming command by the controller device to the subset of remote devices to cause the subset of remote devices to prepare for detonation. The method yet further includes issuing a firing command by the controller device to the subset of remote devices by simultaneously selecting dual fire switches together on the controller device to cause the subset of remote devices to detonate explosives.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
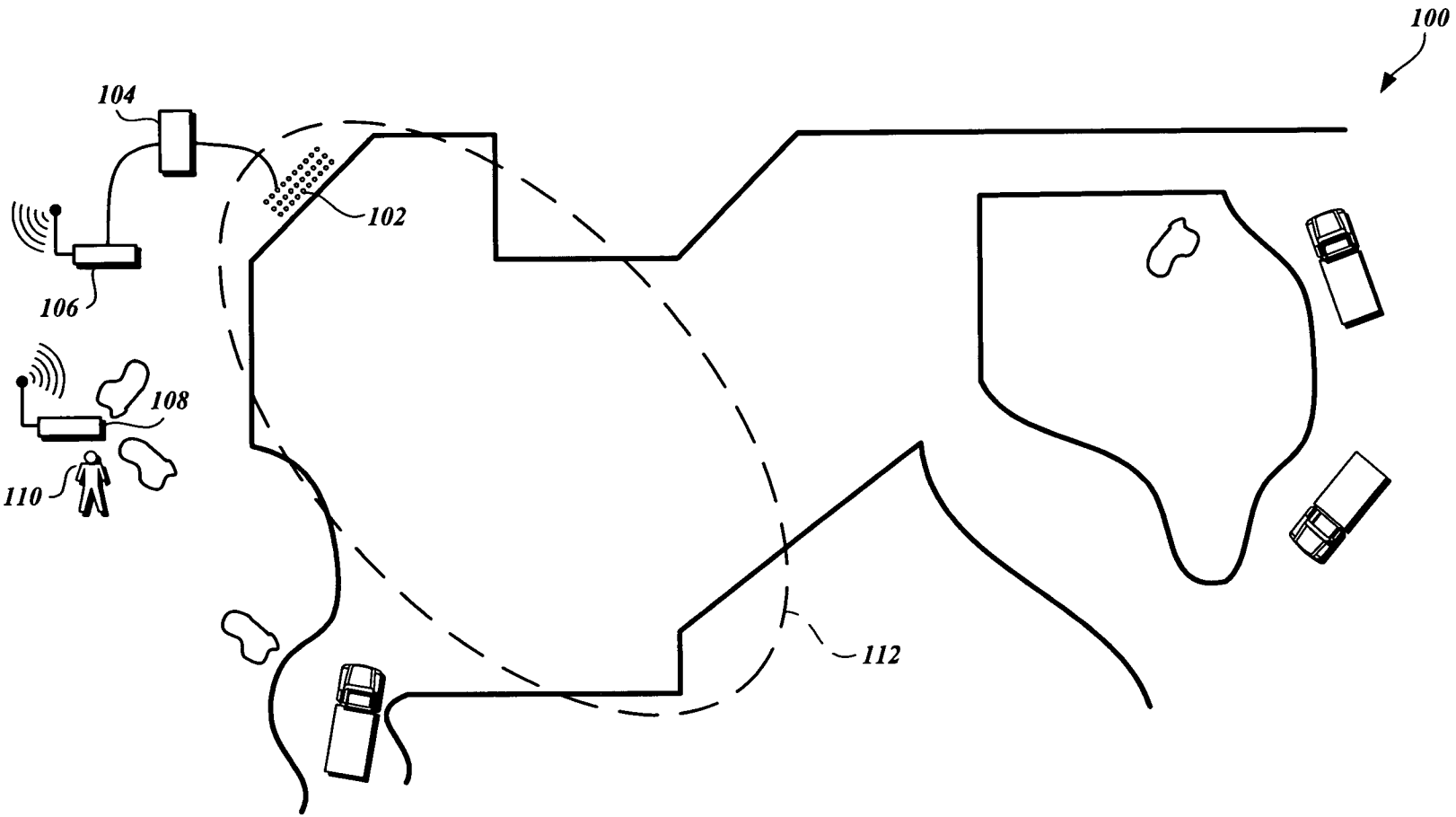
FIG. 1 is a pictorial diagram showing a plan view of an open pit surface mine, wherein conventional blasting techniques are employed.

FIG. 1 depicts a plan view of surface mining in an open pit mine 100. By way of example, there may exist one or more groups of explosives 102, known as shots. Although not shown, other shots may be situated in various locations throughout the mine depending on where the blasting will occur. The shot 102 (and all of the detonators within the shot) may be tethered to a blasting machine 104, or it may be tethered directly to a remote device 106. The blasting machine 104 is further tethered to the remote device 106, which is in communication with a controller 108. The blasting system is controlled by an operator 110 at the controller 108. The operator 110 may initiate a blasting sequence by transmitting one or more signals using the controller 108 to the remote device 106, which may command the blasting machine 104 to initiate the detonators in the shot 102 depending on the type of detonators. While FIG. 1 shows the blasting machine 104, the remote device 106, and the controller 108 in communication wirelessly or by wire, one of skill in the art will appreciate that any type of communication link may also be used between the varying devices.

In the open pit mine 100, a danger area 112 is associated with loose rock, known as fly rock, which can be thrown great distances by the explosive force released upon detonation of the shot 102. To ensure safety, the blasting machine 104, the remote device 106, the controller 108, and the operator 110 is suitably be located outside the perimeter of the danger area 112. Similarly, vehicles and other mine employees (not shown) are suitably also be located outside the perimeter of the danger area 112. Although mine personnel (not shown), known as spotters, guard areas of ingress to the mine that cannot be observed by the operator 110, there still exists a danger that someone or something will enter the danger area 112. There also exists a risk of third-party access to any of the communication links between the devices. Accordingly, various embodiments of the disclosed subject matter, as discussed in more detail below, provide for additional safety features within the controller 108 and the remote device 106 to mitigate the safety risks.

Figure 2:
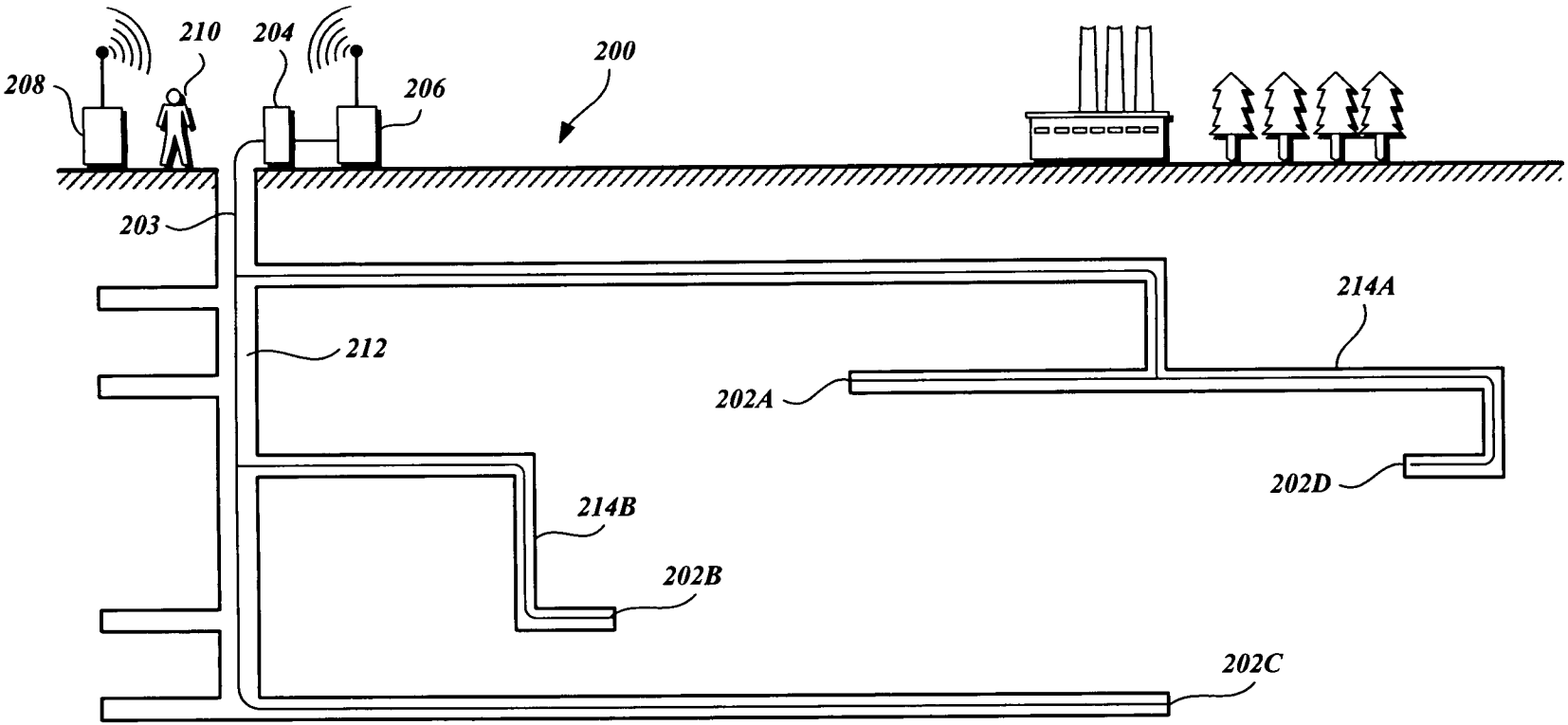
FIG. 2 is a pictorial diagram showing a cross-sectional illustration of a subterranean mining operation.

FIG. 2 depicts a cross-sectional view of blasting carried out in a subterranean mine 200. As in surface mining (as seen in FIG. 1), a blasting machine 204 and a lead line 203 are used to detonate explosives in headings 202A-D. As with surface mining, shots containing the explosive charges are placed in the headings 202A-D of working shafts 214A-B. The working shafts 214A-B connect to a main shaft 212. The main shaft 212 leads to the surface and carries the lead line 203 from the blasting machine 204 located at the surface, to the headings 202A-D. Due to the dangers of cave-ins for subterranean mining, entire mines are generally shut down and evacuated prior to detonation of explosives. This requires evacuation of both an operator 210 and other mine personnel (not shown) to the surface. As in surfacing mining, the safety features of the various embodiments of the disclosed subject matter decrease the risk associated with blasting operations.

Figure 3:
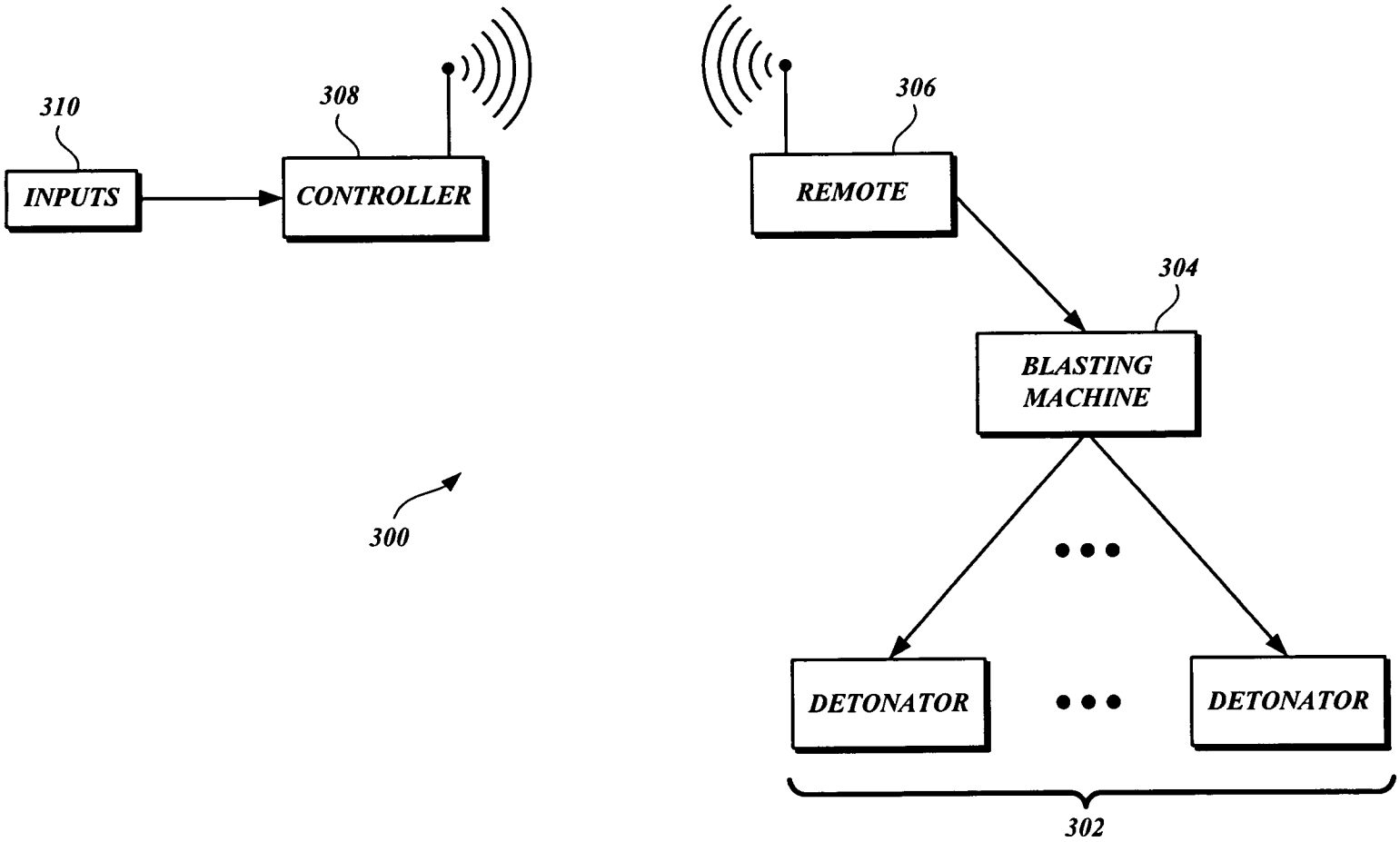
FIG. 3 is a pictorial diagram illustrating a remote firing system using safety communication according to one embodiment.

FIG. 3 depicts a generalized view of a blasting system 300 as used in surface mining (FIG. 1), subterranean mining (FIG. 2), or the like. A group of explosives 302 include various detonators. Depending on the type of detonator in the group of explosives 302, it may be coupled directly to a remote device 306, or it may be coupled to a blasting machine 304, which in turn is coupled to the remote device 306. The remote device 306 is in communication with a controller 308, which receives inputs 310 from an operator, such as the operator 110 in FIG. 1, or from some other input source. As noted above, while FIG. 3 depicts various communication links between devices as either wired or wireless, one of skill in the art will appreciate that any type of communication link may be used as long as the information transmitted is accurate.

According to various embodiments of the disclosed subject matter, the detonators in the group of explosives 302 are detonated by the blasting machine 304 or the remote device 306 when an ARM (enables the initiator or charging mechanism in the detonator) and/or a FIRE (releases the initiator or charging mechanism in the detonator) command is sent. The blasting machine 304 or the remote device 306 may also discharge the initiator or charging mechanism in the detonator upon receiving a DISARM command from the remote device 306. The DISARM command may initiate in the controller 308 or in the remote device 306, as discussed in more detail below. If the blasting machine 304 receives a STATUS command from the remote device 306, information relating to the status of a detonator in the group of explosives 302 will be sent to the remote device 306. Status information includes, for example, arming/disarming of the detonator, or a status error in firing of the detonator.

The remote device 306 sends messages to the blasting machine 304 as previously noted, but also sends and receives messages by way of the controller 308. According to various embodiments of the disclosed subject matter, and as will be discussed in more detail below, the remote device 306 and controller 308 communicate using a security protocol, such as a code word embedded in the transmitted signal, to ensure authenticity of the message communicated and so that third-parties cannot interfere with messages received or sent. Additionally, the controller 308 receives the inputs 310 to manage the blasting operation by configuring to send arming, disarming, and firing commands from the controller 308 to the remote device 306, which may in turn send the commands to the blasting machine 304 for firing or disarming of the detonators in the group of explosives 302.

Figure 4:
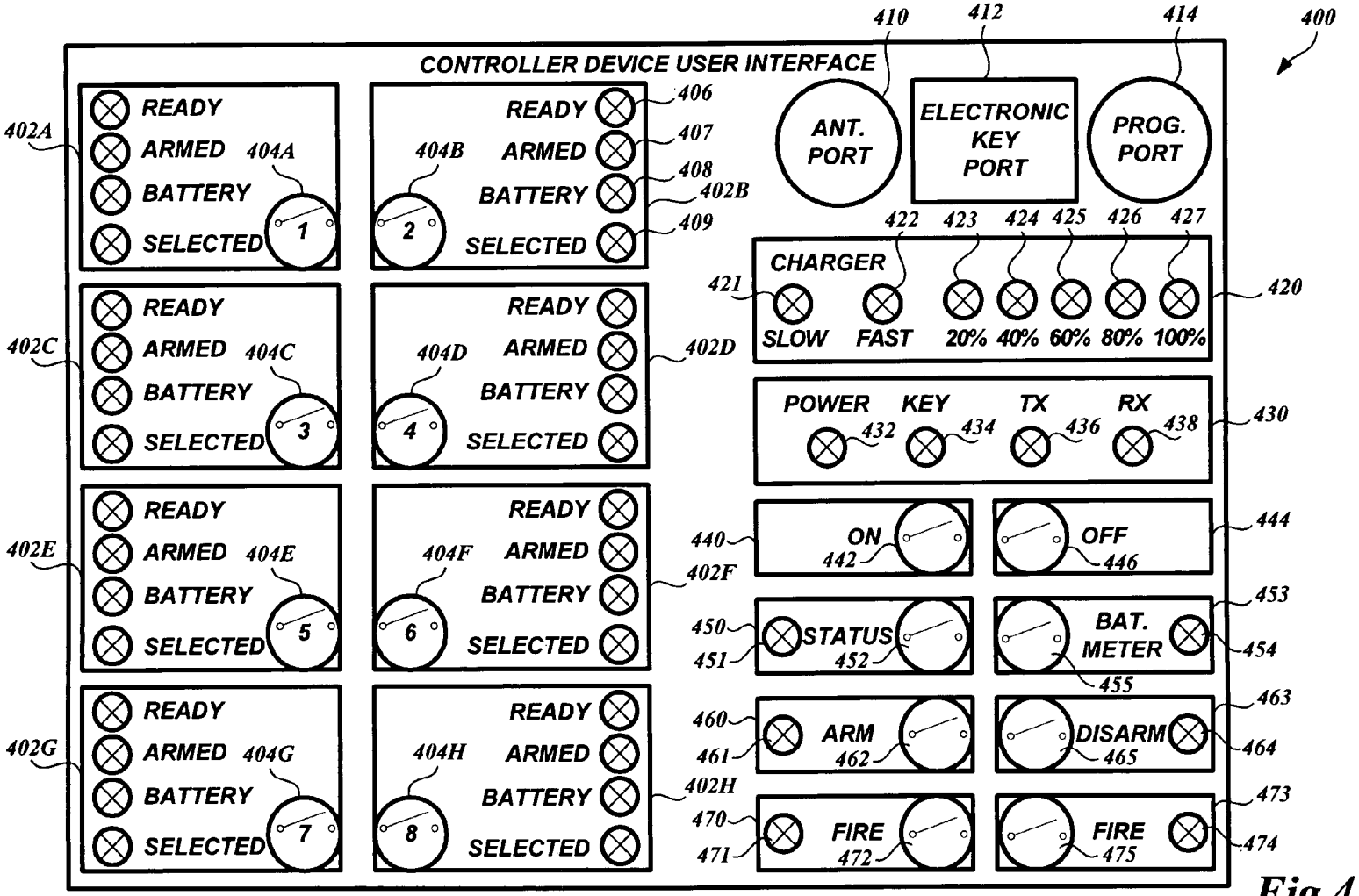
FIG. 4 is a pictorial diagram of a controller device user interface, in accordance with one embodiment.

FIG. 4 illustrates an exemplary front panel for a controller device user interface 400 in accordance with one embodiment of the disclosed subject matter. Any suitable number of remote devices (not shown) are controllable from the controller device user interface 400. The left portion of the controller device user interface 400 includes selection and remote device panels 402A-H for eight remote devices. Each remote device panel 402A-H includes membrane switches 404A-H that allows selection or deselection of an associated remote device. Further, each remote device panel 402A-H includes labeling and light indicators, such as LEDs or the like, for a READY state 406, ARMED state 407, battery condition 408, and selected state 409 of the associated remote device.

The right portion of the controller device user interface 400 includes a controller device interface, an informational interface, and a user input section interface. The controller device interface includes an external antenna connection port 410, an electronic key interface 412, and a programming port 414. The informational interface includes a controller device battery status panel 420, including labeling and light indicators, such as LEDs or the like, for a slow charge 421, a fast charge 422, a 20% remaining battery capacity 423, a 40% remaining battery capacity 424, a 60% remaining battery capacity 425, a 80% remaining battery capacity 426, and a 100% remaining battery capacity 427. These percentages of remaining battery capacity are arbitrarily selected and other percentages, or different styles of display, can be substituted in other embodiments without departing materially from the scope of the disclosed subject matter.

The informational interface includes a panel 430 containing labeling and indicator lights, such as LEDs or the like, for a device power 432, an electronic key status 434, a device transmitting 436, and a device receiving 438. Additionally, the user input selection interface comprises panels 440, 444, 450, 453, 460, 463, 470, and 473. The panel 440 is used for placing a controller device in the ON state with the membrane switch 442. The panel 444 is used for placing a controller device in the OFF state with the membrane switch 446. The panel 450 is used for selecting a status query operation with the membrane switch 452. The panel 453 is used for placing the controller device battery status panel 420 in an ON or OFF state by cycling the membrane switch 455. The panel 460 is used for selecting an ARM command operation with the membrane switch 462. The panel 463 is used for selecting a DISARM command operation with the membrane switch 465. The dual panels 470 and 473 are used for selecting a FIRE command operation with the dual membrane switches 472 and 475.

The panels 450, 453, 460, 463, 470, and 473 further include labeling and indicator lights 451, 454, 461, 464, 471, and 474, respectively, such as LEDs or the like. Combinations of the aforementioned light indicators can be used to indicate device conditions. One example is flashing of all light indicators when the device is placed in the ON state, which also indicates the initiation of a self-testing operation. Other suitable combinations are possible as well.

Figure 5:
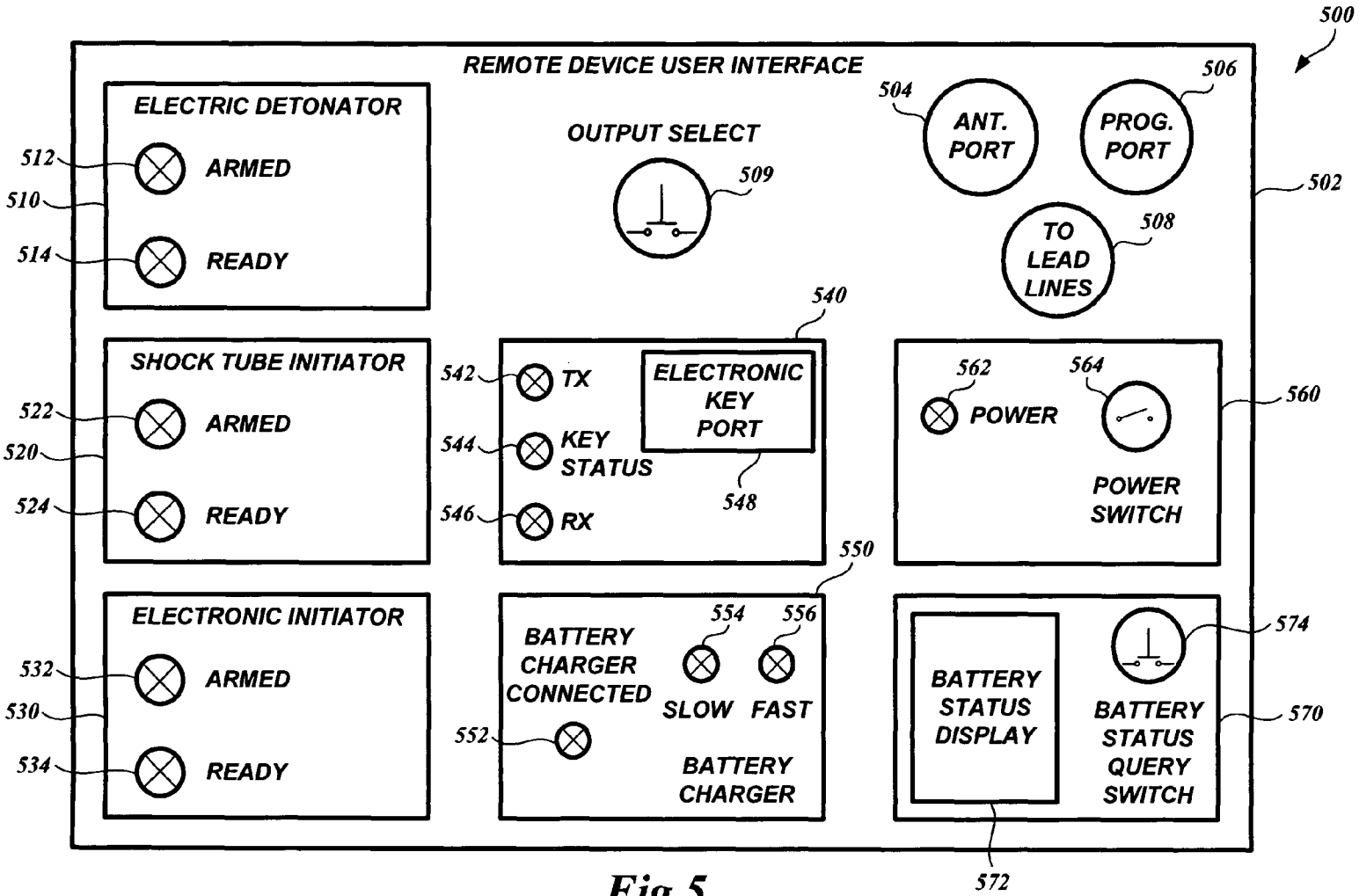
FIG. 5 is a pictorial diagram illustrating a remote device user interface, in accordance with one embodiment.

FIG. 5 illustrates an exemplary front panel 500 for a remote device user interface 502. The remote device user interface 502 includes an external antenna port 504 and a programming port 506. The remote device user interface 502 further includes an electronic initiator port (not shown) connected to the blasting machine, as well as a lead line connection port 508 for connecting lead lines directly to the detonators. The electronic initiator port may be located on the side of the remote device 306 or other suitable location. One of ordinary skill will also appreciate that the electronic port may be a serial port or other suitable port, and it may use a suitable communication protocol when communicating with the blasting machine. For example, the blasting machine and the electronic initiator port may communicate using protocol RS232, or the like.

As further seen in FIG. 5, the lead line connection port 508 is shown on the face of the remote device user interface 502, but may be located on the left sidewall of the remote device or other suitable location on the remote device. An output select switch 509 selects an initiation method associated with panels 510, 520, or 530. In accordance with one embodiment, the output select switch 509 may be a mechanical toggle switch. In other embodiments, the output select switch 509 may be a pushbutton switch, or other switch capable of selecting one initiation method at a time. The panels 510, 520, or 530 each correspond to different types of detonators. The panel 530 is used for electronic detonators connected to the blasting machine 304 through the electronic initiator port. The panel 510 is used for electric detonator initiation, and the panel 520 is used for shock tube detonator initiation. Both types of detonators are connected to the remote device 306 through the lead line connection port 508.

The electric detonator panel 510, the shock tube initiator panel 520, and the electronic initiator panel 530 all include labeling and light indicators 512, 514, 522, 524, 532, and 534, respectively, such as LEDs or the like, for READY and ARMED status. The remote device user interface 502 further includes an electronic key panel 540 and a battery charger panel 550. The electronic key panel 540 includes a connection port 548 to couple to an electronic key; three light indicators 542, 544, and 546, such as LEDs or the like, which indicate remote device transmission, electronic key status, and remote device receiving in accordance with safety communication ability of various embodiments of the disclosed subject matter. A battery charger panel 550 includes a labeling and light indicator 552, such as an LED or the like, for indicating connectivity to a battery charger. Two additional light indicators 554 and 556 with labeling, indicate slow and fast charging rates.

A power panel 560 on the remote device user interface 502 is used for placing the remote device in an ON or OFF state, and includes a labeling and light indicator 562, such as an LED or the like, and a remote device power switch 564. A remote device battery status panel 570 includes a switch 574 for activating a battery status display 572, such as a digital voltmeter, for example. In accordance with one embodiment, switches 564 and 574 may be mechanical momentary push button switches, or other suitable switches.

In one embodiment of the disclosed subject matter, combinations of the aforementioned light indicators on the remote device user interface 502 are used to indicate various device conditions. One such example is the slow charge light indicator 554 being lit and the fast charge light indicator 556 being dark to indicate a fully charged battery. Given that there is not an exhaustive list of all combinations of light indications for various other conditions experienced while operating a blasting operation in accordance with the disclosed subject matter, other combinations of light indicators are possible.

Figure 6:
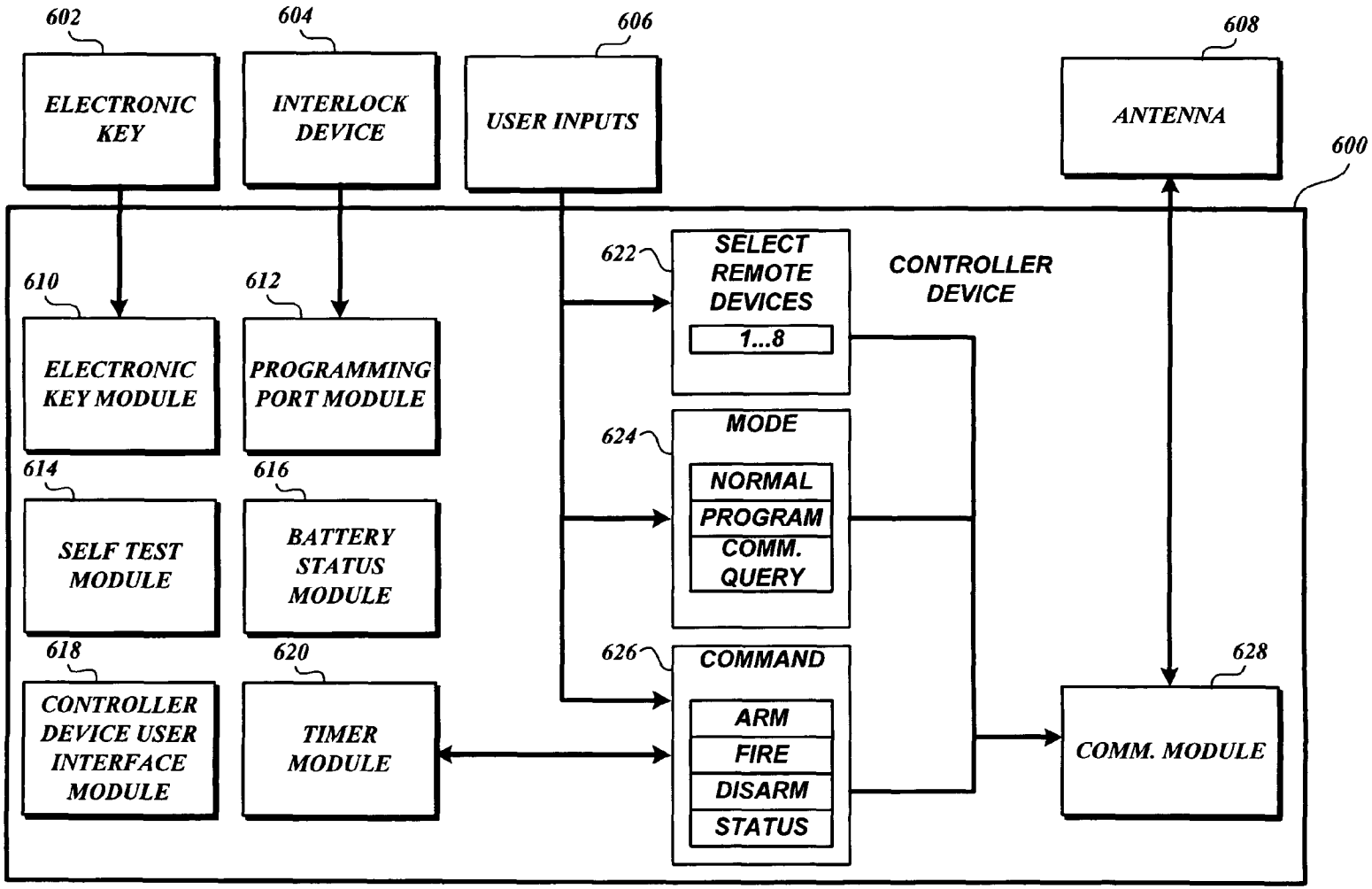
FIG. 6 is a block diagram showing various inputs, outputs, and internal control modules for a controller device, in accordance with one embodiment.

FIG. 6 is a block diagram of internal functional modules, inputs, and outputs for a controller device 600. Inputs to the controller device 600 can be received as information stored on an electronic key 602, information from an interlock device 604, information from user inputs 606, and information from an antenna 608. The internal functional modules are coupled to the electronic key 602, interlock device 604, and user inputs 606, and include an electronic key module 610, programming port module 612, self-test module 614, battery status module 616, controller device user interface module 618, timer module 620, remote device selection module 622, controller device mode module 624, controller device command module 626, and communications module 628 for transmitting and receiving safety communication. Safety communication is preferably achieved by transmitting and receiving safety data through the external antenna 608 coupled to the communications module 628. Other devices, including but not limited to radio repeaters and leaky feeder systems, can be connected in place, or in addition to, the external antenna 608 without departing materially from the scope of the disclosed subject matter.

The electronic key module 610 serves as a coupling interface between the controller device 600 and external electronic key 602. Information stored on the electronic key 602 is read into the internal memory (not shown) of the controller device 600 for processing. The controller device 600 may also write information onto the electronic key 602 through the electronic key module 610.

The programming port module 612 serves as a coupling interface between the controller device 600 and an external programming device, such as a digital computer or the interlock device 604. The external programming device may allow, for example, information stored in certain memory locations (not shown) to be read out of the controller device 600, information to be written into certain memory locations (not shown) in the controller device 600, or modification of settings for the controller device 600, among others. Many operations can be conducted through the programming port module 612, and it may be implemented using a 14-pin DIN type connector or other suitable connectors, designating various conductors for functionality such as battery charger contacts, the interlock device 604 input contacts, programming function contacts, and contacts for additional future functionality, among others.

The self-test module 614 tests the internal circuitry and functionality of the controller device 600 for faults. The self-test module 614 indicates component failures by flashing indicator lights, such as LEDs or the like, on the controller device 600, as discussed previously. Other suitable methods of indicating self-test results can be used without departing from the scope of the disclosed subject matter.

The battery status module 616 displays the status and condition of a battery (not shown) in the controller device 600. The battery status module 616 may include a battery capacity display, such as a gas-gauge style digital display, battery condition indicators, such as the previously discussed flashing indicator light 454 on the controller device user interface panel 400, and recharge rate indicator lights, such as LEDs, on the panel 420, among others. Other suitable displays and indicators can be used without departing from the scope of the disclosed subject matter.

The controller device user interface module 618 handles all user input for the controller device 600 not handled by the remote device selection module 622, controller device mode module 624, or controller device command module 626. Functions carried out by the controller device user interface module 618 include functions such as turning a battery meter ON or OFF, among others.

The timer module 620 can be implemented mechanically, with discrete electronics, with software, or by some combinations thereof. Preferably, the timer module 620 is used for the controller device 600 features requiring elapsed time information. For example, the timer module 620 may have a countdown timer that triggers the execution of a DISARM command as an automatic safety feature. When the controller device 308, as seen in FIG. 3, transmits an ARM command to the remote device 306, the timer module 620 may begin a countdown sequence in which the controller 308 must initiate a FIRE command to the remote device 306. If there is no fire command initiated before the timer module 620 ends the countdown sequence, a DISARM command will be sent to the remote device 306, and the detonators will be disarmed.

The remote device selection module 622 serves as an interface for the operator 110 allowing specific remote devices to be either selected or deselected. Preferably, multiple remote devices can be contemporaneously selected and operated from a single controller device. Additionally, it is preferable that the controller device command module 626 serve as the operator interface to selectively initiate command signals. The available commands may include ARM, FIRE, DISARM, and STATUS (querying the status of remote devices), among others. Other suitable commands can be used without materially departing from the scope of the disclosed subject matter.

The controller device mode module 624 serves as the operator interface for selecting the operating mode of the controller device 600. The controller device mode module 624 may include NORMAL (signifying normal operation mode), PROGRAMMING (signifying programming mode), and QUERY (signifying safety communication query mode, such as the SAFETY POLL™ query facility offered by Rothenbuhler Engineering Co.), among others. The NORMAL mode is preferably the default mode and is used for detonating explosives. The PROGRAMMING mode preferably allows the controller device 600 to function as a programming device for programming electronic keys, or other programmable options. The QUERY mode is preferably used to automatically test safety communication between the controller device 600 and selected remote devices (not shown). Additional suitable modes or suitable modifications of the listed modes can be included in the controller device mode module 624 without departing from the scope of the presently disclosed subject matter.

The communications module 628 serves to enable safety communication between the controller 308 and other system devices through a transmission medium. Preferably, the communications module 628 includes a 5-watt maximum power radio transceiver for transmission and reception of radio frequency signals in the kHz to MHz range. Any suitable power or frequency range can be used for the transceiver without departing materially from the scope of the disclosed subject matter, and other suitable methods of communication besides wireless communication may also be used.

Figure 7:
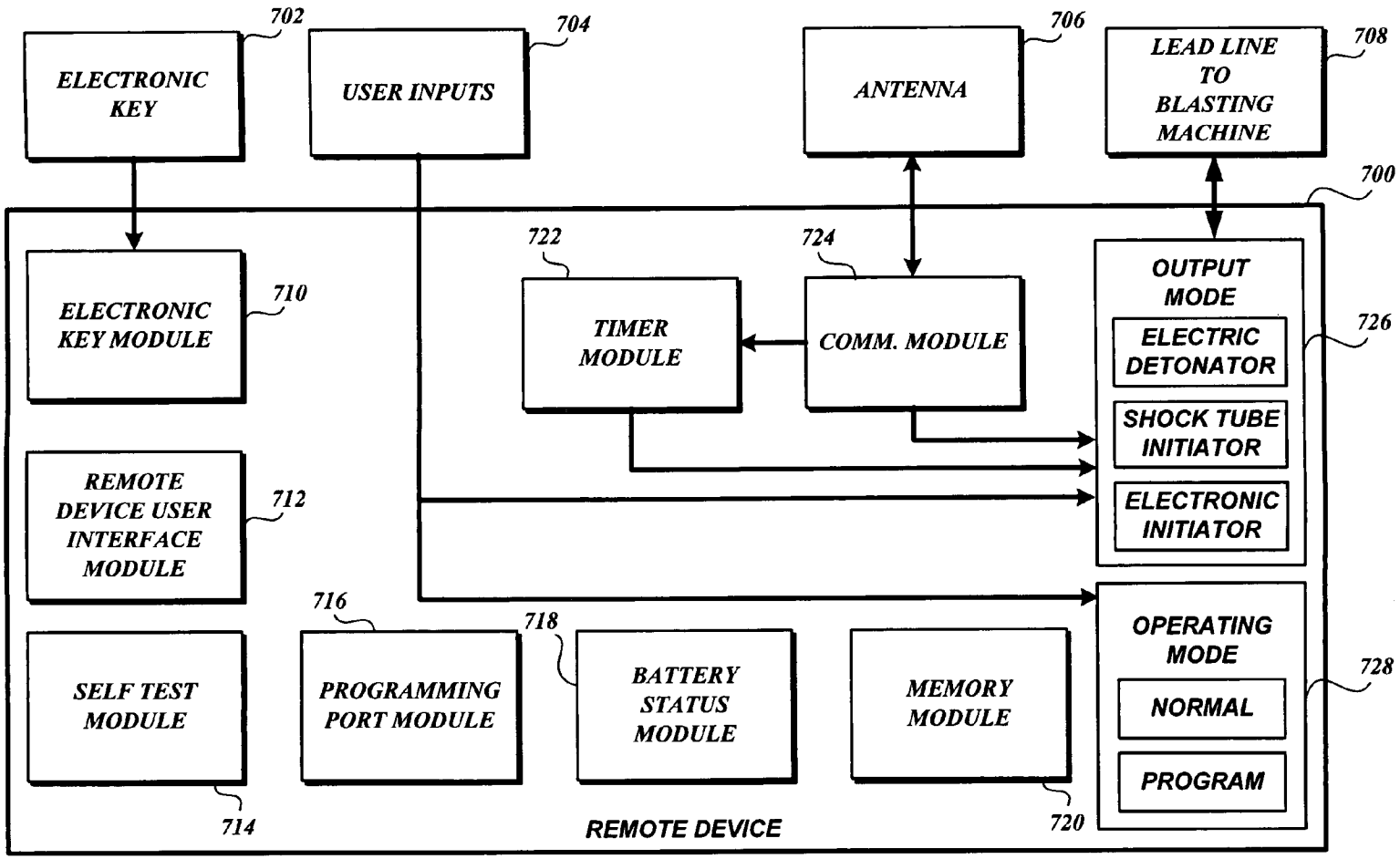
FIG. 7 is a block diagram showing various inputs, outputs, and internal control modules for a remote device, in accordance with one embodiment.

FIG. 7 is a block diagram of the internal functional modules, inputs, and outputs for a remote device 700. Inputs to the remote device 700 include information contained on an electronic key 702, information received from user inputs 704, safety communications can be received or transmitted by an external antenna 706, and signals initiating a shot are output to a blasting machine (not shown) by a lead line interface 708. The internal functional modules include modules such as an electronic key module 710, remote device user interface module 712, self-test module 714, programming port module 716, battery status module 718, memory module 720, timer module 722, communications module 724, remote device output mode module 726, and remote device operating mode module 728, among others.

The electronic key module 710 serves as a coupling interface between the remote device 700 and electronic key 702. Further, information stored on the electronic key 702 can be read into the memory module 720 for processing by the remote device 700 through the electronic key module 710. Additionally, it is preferable that the remote device user interface module 712 handle all user input received by the remote device 700 not handled in the remote device operating mode module 728, or remote device output mode module 726. The remote device user interface module 712 further includes functions such as turning a battery meter ON by depressing a momentary switch, among others.

The self-test module 714 tests the internal circuitry and functionality of the remote device 700 for faults. The self-test module 714 indicates component failures by flashing indicator lights, such as LEDs or the like, on the remote device user interface 502 as previously discussed. Other suitable methods to indicate self-test results can be used.

The programming port module 716 serves as a coupling interface between the remote device 700 and an external programming device (not shown), for example a digital computer. The external programming device may allow, for example, information stored in certain memory locations to be read out of the remote device 700, information to be written into certain memory locations on the remote device 700, or modification of internal remote device settings, among others. Many other suitable operations can be conducted through the programming port module 716, and the programming port module 538 may also be implemented using a 14-pin DIN type connector or other suitable connectors, designating various conductors for functionality such as battery charger contacts, programming function contacts, and contacts for additional future functionality, among others.

The battery status module 718 displays the status and condition of a battery (not shown) in the remote device 700. The battery status module 718 may include a battery capacity display, such as a digital display, battery condition indicators, such as the previously discussed flashing indicator lights on the remote device user interface 502, and recharging rate indicator lights, such as LEDs or the like, among others. Other suitable displays or indicators can be used.

The memory module 720 may be implemented in the remote device 700 as an internal memory. In addition to the information that may be read from and written to the memory module 720 as discussed above, the memory module 720 stores a history log (not shown) of each remote device 700. The history log of each remote device 700 records state changes in the remote device 700 and the time those changes occur. For example, if the remote device 700 is in an ARMED state and subsequently issues a FIRE command to initiate detonation, a state change from ARMED to FIRE will be recorded, with the time of the change, in the history log. By recording each change in state for each remote device 700, better and more accurate diagnostics may be performed to evaluate timing problems or other errors during operation. The history log of each remote device 700 may also be password protected so as to prevent unauthorized access.

The timer module 722 can be implemented mechanically, with discrete electronics, with software, or by some combination thereof. Preferably, the timer module 722 is used for remote device features requiring elapsed time information. For example, as with the timer module 620 of the controller device 600 as above, the timer module 722 may initiate a countdown timer that, when finished, will trigger a DISARM command to disarm the remote device 700 if the remote device 700 has been ARMED and not FIRED within a specified time period. Preferably, the timer module 722 serves as a backup to the timed disarm sequence in the timer module 620 in the controller device 600 as previously discussed.

The communications module 724 serves to enable safety communication between the remote device 700 and other system devices via a transmission medium. Preferably, the communications module 724 includes a 1-watt maximum power radio transceiver for transmission and reception of radio frequency signals in the kHz to MHz range. Any suitable power or frequency range may be used for the transceiver without departing materially from the scope of the presently disclosed subject matter. Further, other suitable methods of communication may be used.

The remote device output module 726 serves as an interface for the operator 110 that allows method selection for initiating a remote detonation (such as electric detonators, shock tube initiators, or electronic initiators, among others). Additionally, it is preferable that the remote device operating mode module 728 serve as an interface to select the operating mode of the remote device 700. The remote device operating mode module 728 may include NORMAL (signifying normal operation mode) and PROGRAMMING (signifying programming mode), among others. The NORMAL mode is preferably the default mode and is used for detonating explosives. The PROGRAMMING mode preferably allows the remote device 452 to be programmed with a semi-permanently assigned device identifier. Additional suitable modes or suitable modifications of the listed modes can be included in the remote device operating mode module 728.

Figure 8:
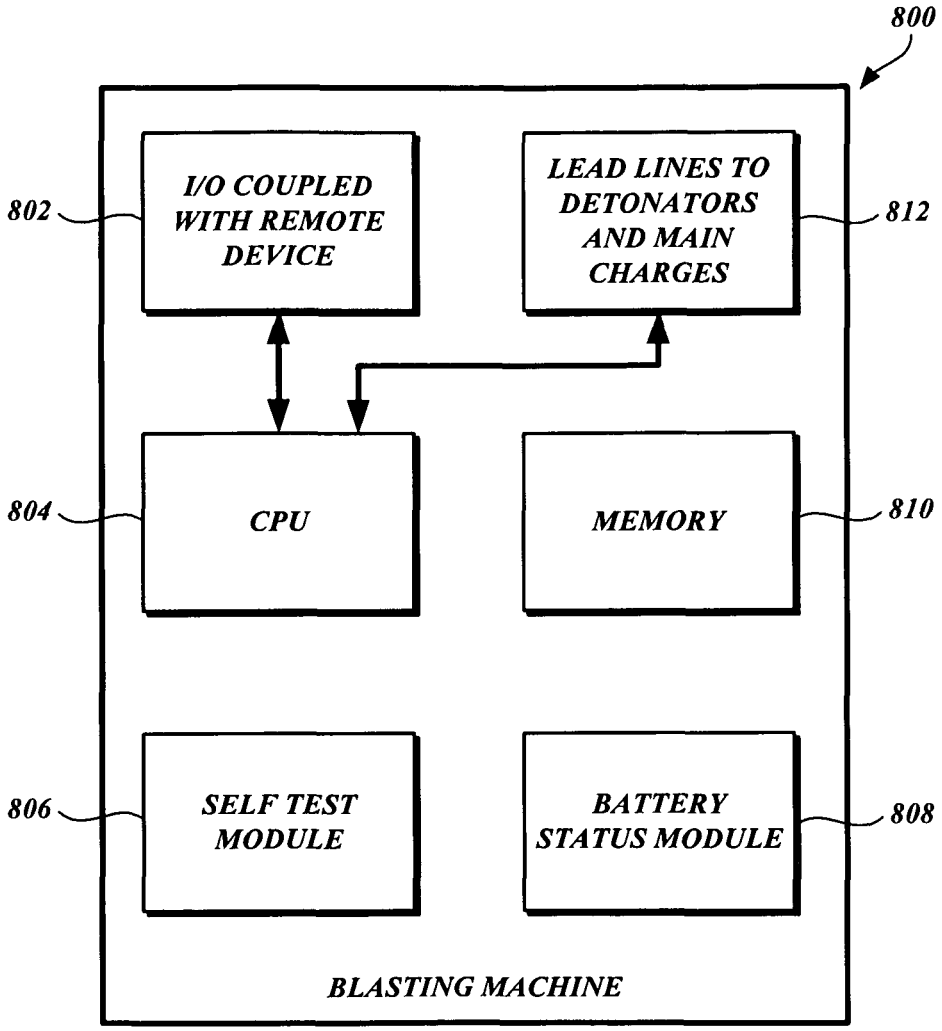
FIG. 8 is a block diagram showing various inputs, outputs, and internal modules for a blasting machine, in accordance with one embodiment.

FIG. 8 is a block diagram of various components in a blasting machine 800 in accordance with aspects of the presently disclosed subject matter. A remote device interface 802 is coupled to the remote device 306, for example, for communication between the blasting machine 800 and remote device 306. A central processing unit 804 carries out processing functions of the blasting machine 800, including communication with the remote device 306 and sending commands to detonators. A memory 810 of the blasting machine 800 may be used in conjunction with the central processing unit 804, but may also store data on attached detonators for further communication. A self-test module 806 tests the internal circuitry and functionality of the blasting machine 800 for faults. If the self-test module 806 detects failures, the blasting machine 800 will communicate the fault information to the remote device 306, which will in turn communicate the fault information to the controller 308. Depending on the fault detected by the self-test module 806 of the blasting machine 800, indicator lights, such as LEDs or the like, on the controller device user interface 502, as previously discussed, may indicate an error. Other suitable methods to indicate self-test results may also be used.

A battery status module 808 monitors and communicates the status and condition of the battery (not shown) in the blasting machine 800. The battery status module 808 may include a battery capacity display, such as a digital display, battery condition indicators, such as the previously discussed flashing indicator lights on the remote device user interface 502, and recharging rate indicator lights, such as LEDs or the like, among others. Other suitable displays or indicators may be used.

A lead line interface 812 of the blasting machine 800 connects to each detonator in the group of explosives 302, and communicates with each detonator in the group of explosives 302. This includes sending initiation commands when the blasting machine 800 receives a FIRE command from the remote device 306, and also includes receiving status information about each detonator in the group of explosives 302. As discussed above, status information about each detonator in the group of explosives 302 may, in turn, be communicated to the remote device 306 and stored in the history log in the memory module 720.

Figure 9:
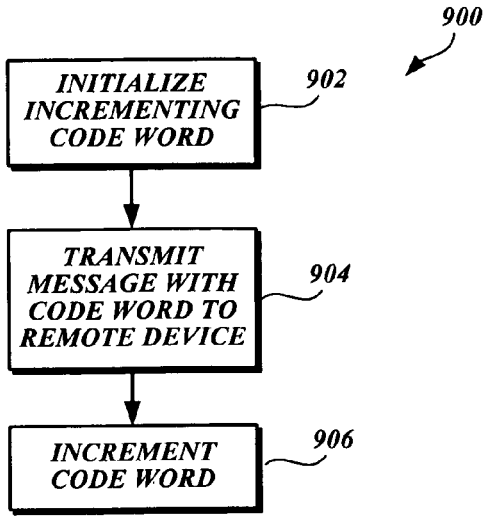
FIG. 9 is a process diagram illustrating a method for communicating by a controller device using secure communication, in accordance with one embodiment.

FIG. 9 is a flow chart describing a preferred method 900 for the controller 308 to securely communicate with the remote device 306. Since the remote device 306 is the only point of entry for commands to the blasting machine 304 and to the group of explosives 302, it is important that there be established a way of ensuring the commands received at the remote device 306 are from the controller 308. According to a preferred method in accordance with the presently disclosed subject matter, at a block 902, the controller 308 initializes a code word to be sent with every data packet message communicated to the remote device 306. The code word preferably consists of 32 bits, but may have more or less bits depending on the communication protocol between the controller 308 and remote device 306, and the level of security desired for communications from the controller 308.

At a block 904, the initialized code word from block 902 is inserted into the outgoing data packet message and sent to the remote device 306. After the controller 308 has sent the data packet message with the initialized code word, the code word is incremented at a block 906 by the controller 308. This newly incremented code word will be inserted into the next data packet message sent to the remote device 306 from the controller 308. One of skill in the art will recognize that any type of incrementing will work, and need not be expressly communicated to the remote device 306, as long as the code word is incremented in some way from the initialized code word.

Figure 10:
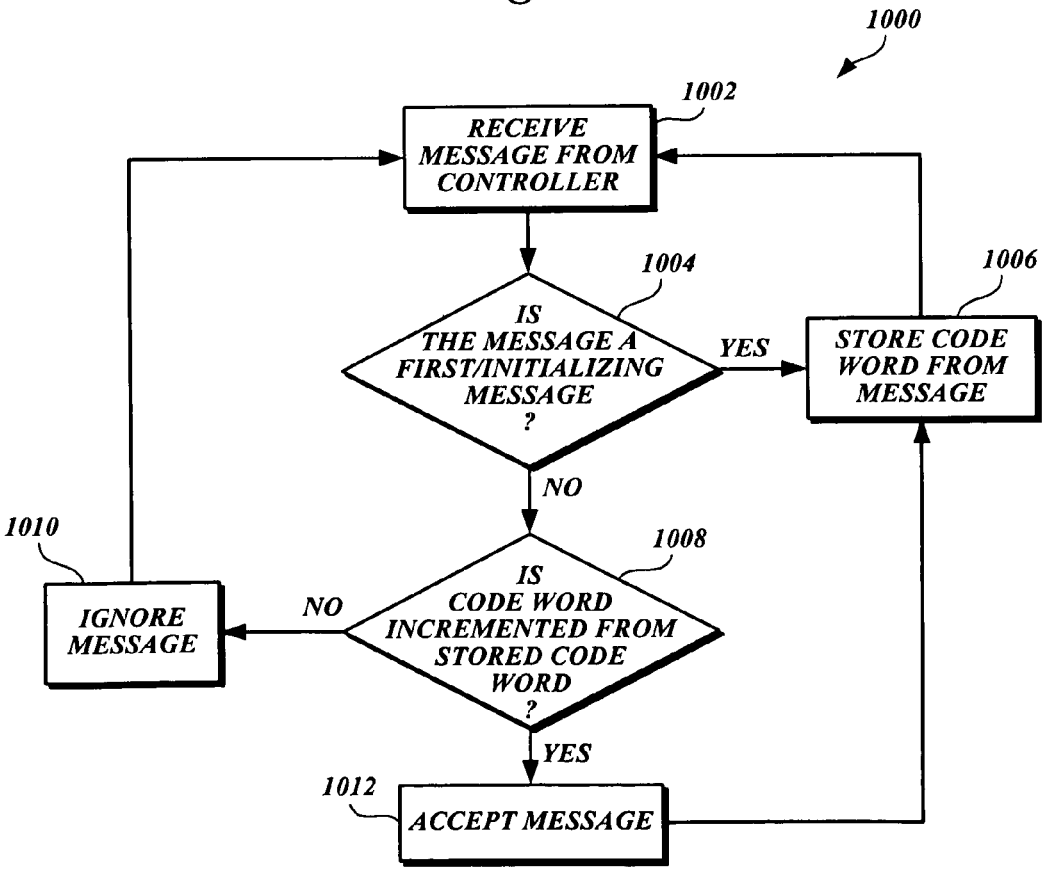
FIG. 10 is a process diagram illustrating a method for receiving and processing by a remote device messages containing security protocol information, in accordance with one embodiment.

FIG. 10 is a flow chart describing a preferred method 1000 of receiving a message at the remote device 306 and validating the source of that message. The remote device 306 receives a data packet message at a block 1002. The entire data packet message may be checked for accuracy using error correcting techniques, such as CRC error checking or the like. In a block 1004, the remote device 306 must check to see if the received data packet message is the first received message from the controller 308. One of skill in the art will appreciate there may be a number of ways to do this. By way of example, the remote device 306 may have a data packet message counter that counts the number of valid messages received. Initially such a counter would be at zero, but after receiving the data packet message with the initialized code word from the controller 308, the remote device 306 would recognize the data packet message as a first message, increase the message count, and store the code word in the remote device 306, as in a block 1006. Any other suitable method for determining if a data packet message is a first message may be used, however, without departing from the scope of the presently disclosed subject matter.

If the data packet message received is not a first message, then the code word from the received message is compared against the stored code word in the remote device 306, as in a block 1008. If the received code word is incremented compared to the stored code word, then in a block 1012 the data packet message is accepted as valid from the controller 308 and executed. The new code word received from the valid data packet message is then stored in the remote device 306 as the new code word as in a block 1006. If the code word received is not incremented compared to the stored code word, then the data packet message is ignored, as in a block 1010. By comparing received code word and stored code word in a block 1008 to see if the code word has been incremented, the blasting system introduces a level of safety that works to prevent third-party access to the remote device 306 and thus to the explosives.

While illustrative embodiments have been illustrated and described, it will be appreciated that various changes can be made therein without departing from the spirit and scope of the disclosed subject matter.

The invention claimed is:

1. A remote firing system comprising:

a set of remote devices, each remote device being capable of communicating a safety data structure that includes a system identifier for indentifying the remote firing system from other remote firing systems and a device identifier for identifying a remote device from other remote devices; and a controller device for causing the set of remote devices to trigger detonators, the controller device being capable of selecting a subset of the set of remote devices for triggering detonators and further being capable of communicating the safety data structure that includes a system identifier for identifying the remote firing system from other remote firing systems and device identifiers for identifying the subset of remote devices to control.

2. The remote firing system of claim 1, wherein each remote device includes a shock tube detonator initiation system and an electric detonator initiating system for detonating explosives.

3. The remote firing system of claim 1, wherein each remote device operates when a compatible remote electronic key is coupled to the remote device and wherein the controller device operates normally when a compatible controller electronic key is coupled to the controller device.

4. The remote firing system of claim 1, wherein the controller device is capable of causing periodic verification of safety communication among the controller device and the subset of the set of remote devices.

5. The remote firing system of claim 1, wherein each remote device is capable of being semi-permanently programmed to take on a temporary identity which is removed upon the removal of an electronic key.

6. A remote firing system comprising:

a set of remote devices, each remote device being capable of communicating a safety data structure that includes a system identifier for identifying the remote firing system from other remote firing systems and a device identifier for identifying a remote device from other remote devices, wherein each remote device is capable of being semi-permanently programmed to take on a temporary identity which is removed upon the removal of an electronic key; and a controller device for causing the set of remote devices to trigger detonators, the controller device being capable of selecting a subset of the set of remote devices for triggering detonators and further being capable of communicating the safety data structure that includes a system identifier for identifying the remote firing system from other remote firing systems and device identifiers for identifying subset of remote devices to control.

* * * * *

UNITED STATES PATENT AND TRADEMARK OFFICE

CERTIFICATE OF CORRECTION

PATENT NO. : 8,474,379 B2
APPLICATION NO. : 12/353203
DATED : July 2, 2013
INVENTOR(S) : T. L. Jacobson et al.

It is certified that error appears in the above-identified patent and that said Letters Patent is hereby corrected as shown below:

In the Claims

| **COLUMN** | **LINE** | |
|---|---|---|
| 12 (Claim 6, line 18) | 41 | after "identifying" insert --the-- |

Signed and Sealed this
Twentieth Day of May, 2014

Michelle K. Lee

Michelle K. Lee
*Deputy Director of the United States Patent and Trademark Office*